US011703210B2

(12) United States Patent
O Farrill Fabela

(10) Patent No.: US 11,703,210 B2
(45) Date of Patent: Jul. 18, 2023

(54) PROTECTIVE THEFT PREVENTATIVE EXTERIOR SHADE FOR LIGHT FIXTURES

(71) Applicant: Luis O Farrill Fabela, Monterrey (MX)

(72) Inventor: Luis O Farrill Fabela, Monterrey (MX)

( * ) Notice: Subject to any disclaimer, the term of this patent is extended or adjusted under 35 U.S.C. 154(b) by 0 days.

(21) Appl. No.: 17/569,983

(22) Filed: Jan. 6, 2022

(65) Prior Publication Data

US 2022/0214029 A1 Jul. 7, 2022

(51) Int. Cl.

| | |
|---|---|
| ***F21V 15/00*** | (2015.01) |
| ***F21V 17/12*** | (2006.01) |
| ***F21V 17/06*** | (2006.01) |

(52) U.S. Cl.

CPC ..... *F21V 15/005* (2013.01); *F21V 17/06* (2013.01); *F21V 17/12* (2013.01)

(58) Field of Classification Search

CPC ..... F21V 15/005; F21V 17/06; F21V 17/12

See application file for complete search history.

(56) References Cited

U.S. PATENT DOCUMENTS 10,746,380 B1 * 8/2020 Mullen ..... F21S 8/04

* cited by examiner

*Primary Examiner* — Sean P Gramling

(74) *Attorney, Agent, or Firm* — Thorpe North & Western, LLP; David W. Osborne

(57) ABSTRACT

The present invention relates to a protective exterior shade/luminaire provided with a thread base cover and a protective canister with light-distributing thread to protect light bulbs installed in ceramic bases/sockets against weather, dust, water, shock and to provide longer life and better appearance of the light bulbs, for use in the home, in industry and in general. The thread of the base cover and the protective canister ensure a secure assembly in a firm manner and prevent the theft of the light bulb and its parts. The protective covers eliminate the need to remove the ceramic bases/sockets, because the protective exterior shade/luminaire is placed between the light bulb and the ceramic bases/sockets.

3 Claims, 13 Drawing Sheets

PROTECTIVE THEFT PREVENTATIVE EXTERIOR SHADE FOR LIGHT FIXTURES

PRIORITY DATA

This application claims priority under the Paris Convention to Mexico Patent Application Serial No. MX/u/2021/000002, filed Jan. 6, 2021, which is incorporated herein by reference.

FIELD OF THE INVENTION

The present invention relates to protective exterior shade/luminaires for lighting fixtures. provided with a thread base cover and a protective canister with light-distributing thread to protect light bulbs of CLF savings (compact fluorescent lamp) or LED bulb type light bulbs installed in ceramic bases/sockets against weather, dust, water, shock and to provide longer life and better appearance of the light bulbs, for use in the home, in industry and in general where there is a need for an exterior shade/luminaire to protect light bulbs of CLF savings (compact fluorescent lamp) or LED bulb type light bulbs installed in ceramic bases/sockets, where the thread of the base cover and the protective canister ensure a secure assembly in a firm manner and prevent the theft of the light bulb and its parts.

The purpose of the protective exterior shade/luminaire provided with a thread base cover and a protective canister with light-distributing thread to protect light bulbs of CLF savings (compact fluorescent lamp) or LED bulb type light bulbs installed in ceramic bases/sockets of the present invention is to protect the light bulbs against weather, dust, water, shock and to provide longer life and better appearance of the light bulbs, furthermore, without the need to remove the ceramic bases/sockets, because the protective exterior shade/luminaire is placed between the light bulb and the ceramic bases/sockets, which results in protective exterior shade/luminaires that are very practical, economical and easy to install, furthermore, the thread of the base cover and of the protective canister ensure a firm assembly and prevent the theft of the light bulb and its parts.

BACKGROUND OF THE INVENTION

At the present time there are known various exterior shields which protect light bulbs or lamps. Most of these exterior shields have to be fixed on surfaces such as the ceiling and walls by means of screws or some other attachment. In some cases the exterior shield may be fixed on ceramic and/or plastic sockets, and once they have been fixed on such surfaces or on the ceramic and/or plastic sockets, they have to be fixed on the ceiling and walls by means of screws or some other attachment. Once fixed on such surfaces or on the ceramic and/or plastic sockets, it is very difficult to exchange them due to the complicated and permanent or semi-permanent installation. It is also difficult to change the light bulbs or lamps when they have burn out and need replacement or maintenance. Accordingly, there is a need for an exterior lamp or light fixture shade to protect light bulbs, particularly in low-income housing, that is easily attached and removed or otherwise addressed.

In some cases, one purpose of the various external shades is to protect light bulbs or lamps, to provide a sufficiently firm and secure grip by adhering to the surfaces to which they are to be fixed, to allow them to be easily interchanged, and to allow light bulbs or lamps to be changed when they have burn out quickly and safely. However, such external shades present a serious problem due to difficulty in exchanging them due to their complicated (and permanent or semi-permanent) installation, as well as to change the bulbs when they have burn out. Further, in some cases, such shades do not distribute the light efficiently, resulting in external shades that provide poor or diminished light from the light bulb, are uncomfortable and time-consuming to install and to exchange bulbs when they have burn out, that are expensive, and that are overall inconvenient to use and maintain.

Some shades are affixed to a lighting fixture using a flange. Such base cover shades provided with flange can present problems because they do not ensure a sufficiently secure assembly in a firm manner. This allows the theft of the light bulb and its parts by easy detachment by vandals when pulling and extracting it. Accordingly, lighting fixtures/shades for lighting fixtures according to the present invention solves all these problems and inconveniences in an easy and secure manner.

A large number of lighting fixtures and devices are known for both indoor and outdoor uses, many of which utilize and exterior shade or protective cover. However, generally speaking such devices are different from the protective exterior shade/luminaire provided with a thread base cover and a protective canister with light-distributing thread to protect light bulbs of the present invention, because its parts are different as well as its functionality, where the thread of the base cover and the protective canister when assembled by turning and coupling their threads ensure a sufficiently more secure assembly in a firm manner and prevent the theft of the light bulb and its parts by vandals, which results in an advantage for the users.

Furthermore, devices according to the present invention that include a protective exterior shade/luminaire provided with a thread base cover and a protective canister with light-distributing thread to protect light bulbs of CLF savings (compact fluorescent lamp) or LED bulb type light bulbs installed in ceramic bases/sockets against weather, dust, water, shock and to provide longer life and better appearance of the light bulbs, where the thread of the base cover and the protective canister ensure a secure assembly in a firm manner and prevent the theft of the light bulb and its parts as compared to prior art devices.

Document U.S. Pat. No. 4,528,764 provides a suspended ceiling sign is provided for suspension within a vacant panel area, under a light fixture, in a suspended ceiling of a regular array of ceiling panels with each panel being peripherally supported within a suspended grid structure. The ceiling sign includes a hollow enclosure having an open top with a peripheral flange configured to engage the supporting grid structure around the vacant panel area. The enclosure has in one of its sidewalls a cutout portion with a translucent sign mounted therein. The bottom of the enclosure has a directed lighting aperture. Inside the enclosure, there is a truncated pyramidal baffle which is both light reflective and translucent. The pyramidal baffle is seated over the aperture in the enclosure bottom. The truncated top of the baffle may be either open or closed with a translucent material. Thus, light emanating from the lighting fixture above the suspended ceiling is partly reflected from the baffle face through the translucent sign, and partly diffused through the translucent baffle to light the aperture in the bottom of the enclosure. However, this suspended ceiling sign is different from the protective exterior shade/luminaire provided with a thread base cover and a protective canister with light-distributing thread to protect light bulbs of CLF savings (compact fluorescent lamp) or LED bulb type light bulbs installed in ceramic bases/sockets against weather, dust, water, shock and to provide longer life and better appearance of the light bulbs, where the thread of the base cover and the protective canister ensure a secure assembly in a firm manner and prevent the theft of the light bulb and its parts of the present invention, because its parts are different as well as its functionality.

DESCRIPTION OF THE INVENTION

The present invention relates to lighting fixtures that can include a protective exterior shade/luminaire provided with a thread base cover and a protective canister with light-distributing thread to protect light bulbs, including bulbs of CLF savings (compact fluorescent lamp) or LED bulb type light bulbs installed in ceramic bases/sockets against weather, dust, water, shock and to provide longer life and better appearance of the bulbs, for use in the home, in industry and in general where there is a need for an exterior shade/luminaire to protect light bulbs of CLF savings (compact fluorescent lamp) or LED bulb type light bulbs installed in ceramic bases/sockets, where the thread of the base cover and the protective canister ensure a secure assembly in a firm manner and prevent the theft of the light bulb and its parts.

The purpose of the protective exterior shade/luminaire provided with a thread base cover and a protective canister with light-distributing thread of the present invention is to protect the light bulbs against weather, dust, water, shock and to provide longer life and better appearance of the light bulbs, furthermore, without the need to remove the ceramic bases/sockets, because the protective exterior shade/luminaire is placed between the light bulb and the ceramic bases/sockets, which results in protective exterior shade/luminaires that are very practical, economical and easy to install, furthermore, the thread of the base cover and of the protective canister ensure a firm assembly and prevent the theft of the light bulb and its parts.

In addition, the thread of the base cover and the protective canister when assembled by turning and coupling their threads, ensure a sufficiently more secure assembly in a firm manner and prevent the theft of the light bulb and its parts by vandals, which results in an advantage for the users.

In a first embodiment of the present invention, the light fixture can include a protective exterior shade/luminaire to protect light bulbs of CLF savings (compact fluorescent lamp) or LED bulb type light bulbs installed in ceramic bases/sockets comprising:

(i) A circular base cover formed by a hollow cylindrical body, having in the central part a hole to pass a thread of a light bulb to a threaded hole of a ceramic base/socket, wherein the central part of the hollow cylindrical body with hole has an angle of inclination for easy fitting of a ceramic base/socket, wherein the upper part of the hollow cylindrical body of the cover has a circular wall provided with an inner circular thread to be screwed by twisting to an upper outer circular thread of a protective canister with light-distributing to protect light bulbs. In some cases, the diameter of the hollow cylindrical body can be greater than the diameter of a ceramic base/socket, wherein the bottom of the hollow cylindrical body of the cover is positioned over the ceramic base/socket so that the hole of the hollow cylindrical body of the cover coincides with the threaded hole of the ceramic base/socket, so as to thread a thread of a light bulb into a threaded hole of a ceramic base/socket when assembled, and wherein the height of the hollow cylindrical body is equal to or less than the height of the ceramic base/socket such that it completely covers said ceramic base/socket;

ii) A protective canister with light-distributing to protect light bulbs of CLF savings (compact fluorescent lamp) or LED bulb type light bulbs installed in ceramic bases/sockets against weather, dust, water, shock and to provide longer life and better appearance, can in some examples be formed by a longitudinally elongated hollow semi-cylindrical body, has at the bottom of the base a slight curvature that provides a better appearance, has at the top an outer circular thread to be threaded by twisting to an inner circular thread of a circular wall of the hollow cylindrical hollow body of the cover so that it is easily installed and uninstalled, wherein the thread of the base cover and the thread of the protective canister ensure a secure assembly in a firm manner and prevent the theft of the light bulb and its parts, wherein the protective canister is a shade/luminaire that protects the light bulbs and light-distributing emitted by the CLF (compact fluorescent lamp) or LED bulb type light bulbs.

In a second embodiment of the present invention, the protective exterior shade/luminaire to protect light bulbs of CLF savings (compact fluorescent lamp) or LED bulb type light bulbs installed in ceramic bases/sockets does not require screws or other attachments for installation on surfaces, does not require removal of the ceramic bases/sockets because the exterior shade/luminaire is placed between the light bulb and the ceramic bases/sockets, which results in very practical exterior shade/luminaires that are easy to install and uninstall, as well as allowing the light bulbs or lamps to be replaced when they have burn out easily and quickly, where the thread of the base cover and the protective canister ensure a secure assembly in a firm manner and prevent the theft of the light bulb and its parts.

In a third embodiment of the present invention, the bottom part of the base of protective canister with light-distributing may also have a completely flat base, and further provide a better appearance and light distribution.

In a fourth embodiment of the present invention, the thread base cover and a protective canister with light-distributing thread of the protective exterior shade/luminaire to protect light bulbs, are manufactured in plastic by injection molding, wherein the plastic is selected from polypropylene (PP) which is the partially crystalline thermoplastic polymer, which is obtained from the polymerization of propylene (or propene), high or low density polyethylene (PE), polyethylene terephthalate (PET), styrene-butadiene, acrylonitrile butadiene styrene polymer (ABS) which is a very impact resistant polymeric plastic widely used in automotive and other industrial and domestic uses, and mixtures thereof, and in any color.

In a fifth embodiment of the present invention, the protective exterior shade/luminaire to protect light bulbs does not use incandescent type bulbs or lamps, and is not fixed to any surface.

In a sixth embodiment of the present invention, the protective canister with light-distributing may further have another shape, such as spherical, hemispherical, spiral, square, diamond, etc., and further provide better appearance and light distribution.

In a seventh embodiment of the present invention, the protective exterior shade/luminaire protects and gives a better appearance to light bulbs installed on ceramic rosette bases/sockets without the need to remove or remove the ceramic base/socket, no wiring maneuvers, no tools are needed to install it, it is placed and adjusted between the ceramic base/socket and the light bulbs in an easy and fast way, just as easy as changing a light bulb, the following are the steps to install it:

a) Remove the light bulbs from the ceramic base/socket;

b) Place the circular thread base cover over the ceramic base/socket making sure that the hole in the thread base cover is aligned and matches the threaded hole in the ceramic base/socket.

c) A light bulb is positioned so that its thread is threaded into the threaded hole of a ceramic base/socket, once the spotlight is positioned or installed, the light bulb will hold the circular threaded base cover securely over the ceramic base/socket, and d) The thread of the protective canister with light-distributing is placed over the thread of the circular base cover and screwed by twisting to form the protective exterior shade/luminaire to protect light bulbs of CLF savings (compact fluorescent lamp) or LED bulb type light bulbs installed in ceramic bases/sockets, when assembled by twisting and coupling their threads is sufficiently safer and in a firm manner, which prevent the theft of the light bulbs and its parts by vandals.

e) In case of changing the light bulbs or the lamps when they have burn out or to replace them, just remove the protective canister with light-distributing thread with a twist to unscrew the circular thread base cover and the light bulbs is uncovered to change or replace it.

DETAILED DESCRIPTION OF THE FIGURES

FIG. 1 shows a side view of an exemplary protective exterior shade/luminaire to protect light bulbs, including incandescent bulbs, as well as bulbs of CLF savings (compact fluorescent lamp) or LED bulb type light bulbs, installed in ceramic bases/sockets against weather, dust, water, shock and to provide longer life and better appearance of the bulbs, that ensure a secure assembly in a firm manner and prevent the theft of the light bulb and its parts, in which (1) represents an protective exterior shade/luminaire, (2) represents a circular thread base cover, (3) represents a protective canister with light-distributing thread to protect light bulbs, and (4) represents a slight curvature that provides a better appearance and distributes the light emitted by the light bulbs.

FIG. 2 shows a bottom view of an exemplary protective exterior shade/luminaire to protect light bulbs including incandescent as well as bulbs of CLF savings (compact fluorescent lamp) or LED bulb type light bulbs installed in ceramic bases/sockets against weather, dust, water, shock and to provide longer life and better appearance of the bulbs, that ensure a secure assembly in a firm manner and prevent the theft of the light bulb and its parts, in which (2) represents a circular thread base cover, (3) represents a protective canister with light-distributing thread to protect light bulbs, and (4) represents a slight curvature that provides a better appearance and distributes the light emitted by the light bulbs.

FIG. 3 shows a top view of an exemplary protective exterior shade/luminaire to protect light bulbs, including incandescent bulbs and bulbs of CLF savings (compact fluorescent lamp) or LED bulb type light bulbs installed in ceramic bases/sockets against weather, dust, water, shock and to provide longer life and better appearance of the bulbs, that ensure a secure assembly in a firm manner and prevent the theft of the light bulb and its parts, in which (2) represents a circular thread base cover and (5) represents a hole in the central part of the circular thread base cover.

FIG. 4 shows an assembled lower isometric view of an exemplary protective exterior shade/luminaire to protect light bulbs, including incandescent bulbs and bulbs of CLF savings (compact fluorescent lamp) or LED bulb type light bulbs installed in ceramic bases/sockets against weather, dust, water, shock and to provide longer life and better appearance of the bulbs, that ensure a secure assembly in a firm manner and prevent the theft of the light bulb and its parts, in which (1) represents an protective exterior shade/luminaire, (2) represents a circular thread base cover, (3) represents a protective canister with light-distributing thread to protect light bulbs.

FIG. 5 shows an assembled top isometric view of an exemplary protective exterior shade/luminaire to protect light bulbs, including incandescent bulbs and bulbs of CLF savings (compact fluorescent lamp) or LED bulb type light bulbs installed in ceramic bases/sockets against weather, dust, water, shock and to provide longer life and better appearance of the bulbs, that ensure a secure assembly in a firm manner and prevent the theft of the light bulb and its parts, in which (1) represents an protective exterior shade/luminaire, (2) represents a circular thread base cover, (3) represents a protective canister with light-distributing thread to protect light bulbs and (5) represents a hole in the central part of the circular thread base cover.

FIG. 6 shows a side view of an exemplary circular thread base cover for a protective canister with light-distributing thread for protective exterior shade/luminaire of the present invention, in which (2) represents a circular thread base cover and (5) represents a hole in the central part of the circular thread base cover.

FIG. 7 shows a top view of an exemplary circular thread base cover for a protective canister with light-distributing thread for protective exterior shade/luminaire of the present invention, in which (2) represents a circular thread base cover, (5) represents a hole in the central part of the circular thread base cover and (6) represents an inner circular thread to be threaded by twisting to an upper outer circular thread of a protective canister with light-distributing thread (not shown).

FIG. 8 shows a bottom view of an exemplary circular thread base cover for a protective canister with light-distributing thread for protective exterior shade/luminaire of the present invention, in which (2) represents a circular thread base cover and (5) represents a hole in the central part of the circular thread base cover.

FIG. 9 shows a top isometric view of an exemplary circular thread base cover for a protective canister with light-distributing thread for protective exterior shade/luminaire of the present invention, in which (2) represents a circular thread base cover, (5) represents a hole in the central part of the circular thread base cover, (7) represents an upper circular wall provided with an inner circular thread (6) to be threaded by twisting to an upper outer circular thread of a protective canister with light-distributing thread (not shown).

Figure 1:
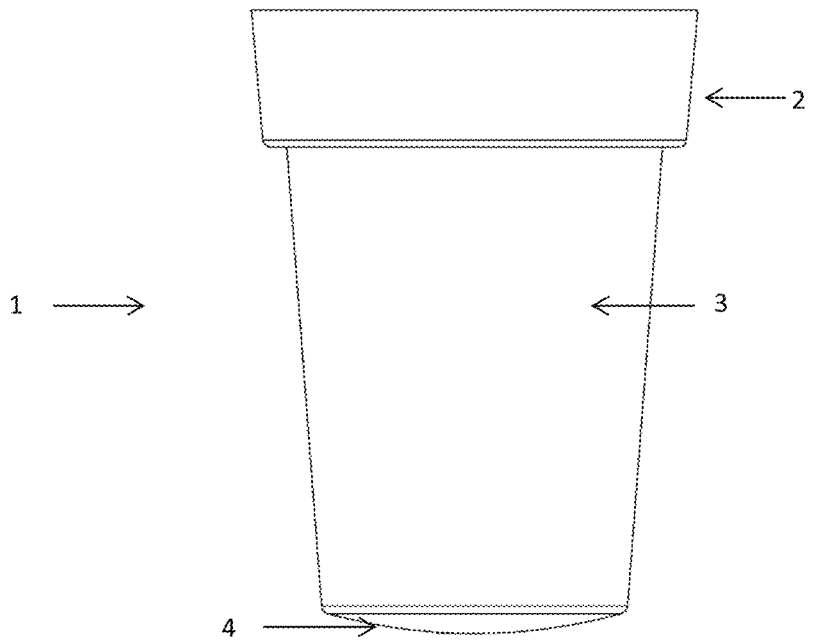
Figure 2:
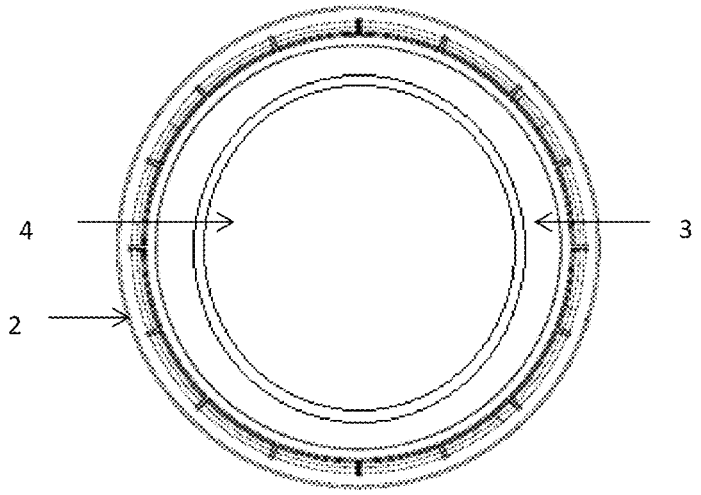
Figure 3:
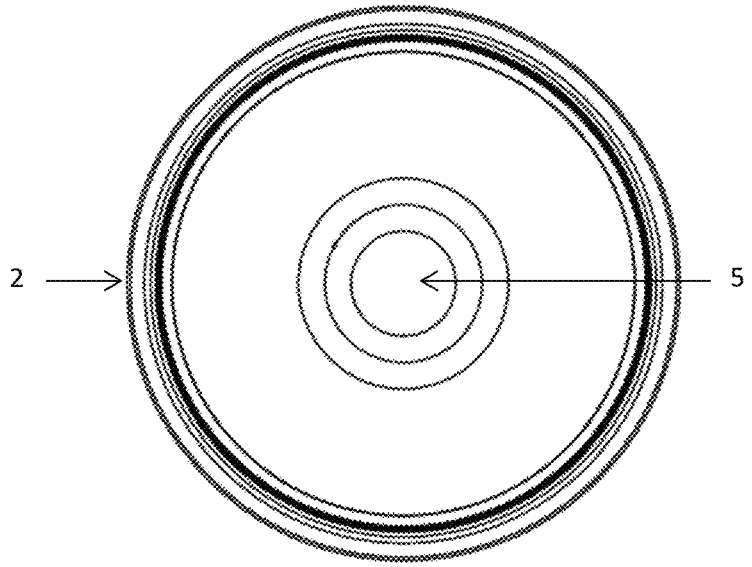
Figure 4:
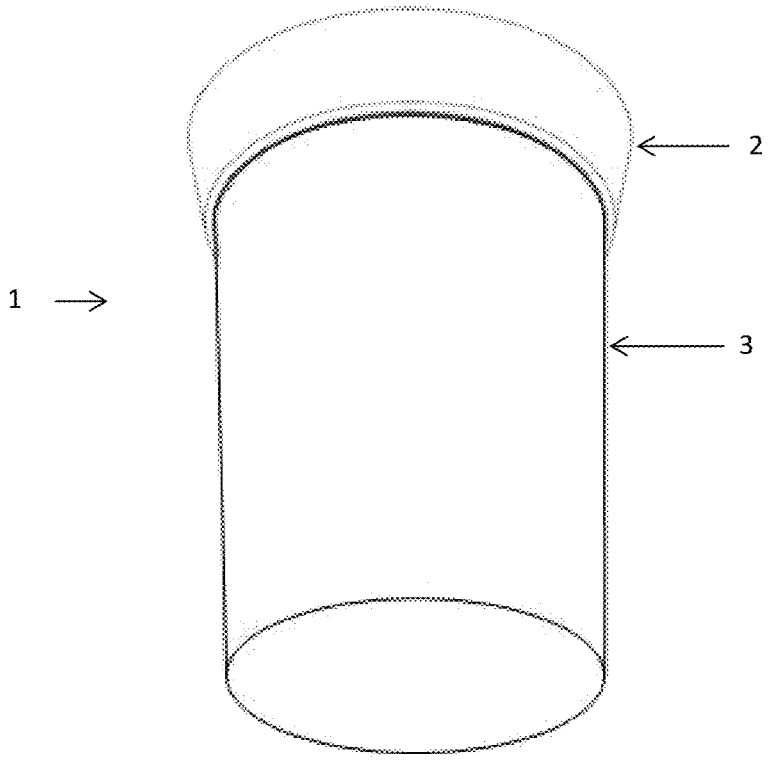
Figure 5:
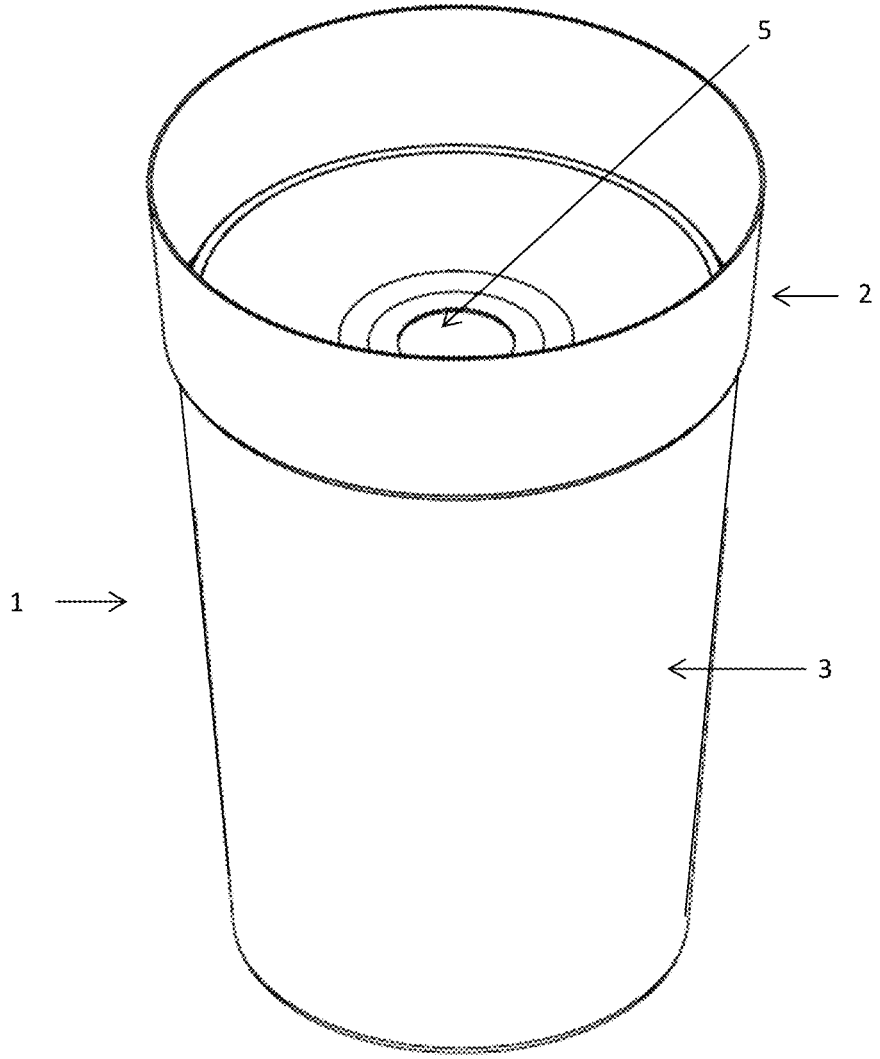
Figure 6:
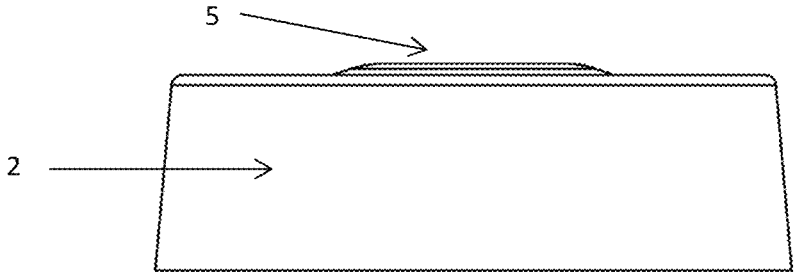
Figure 7:
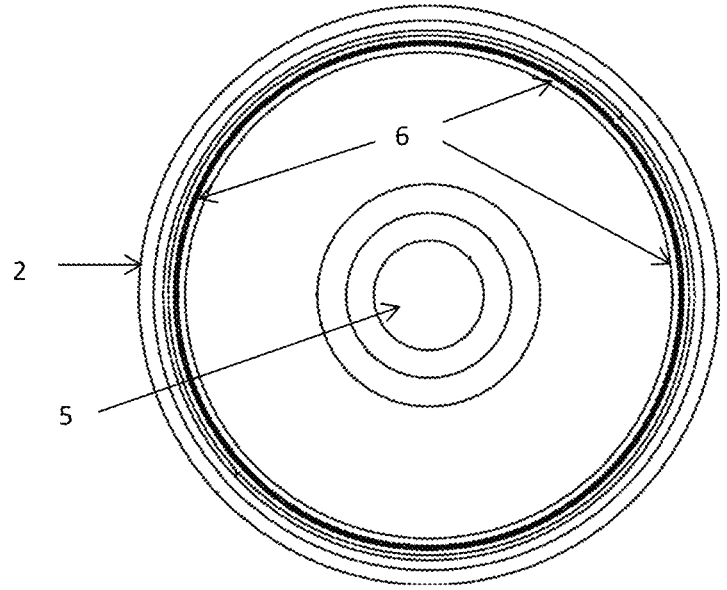
Figure 8:
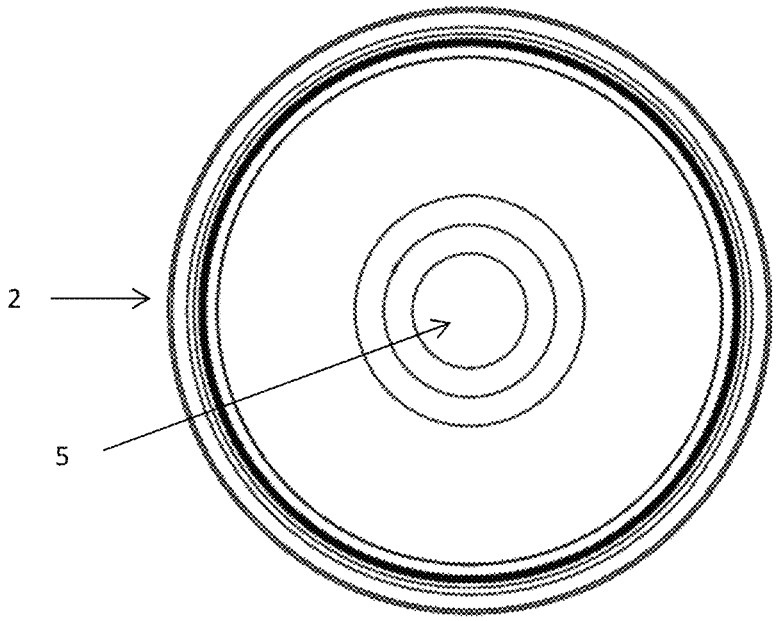
Figure 9:
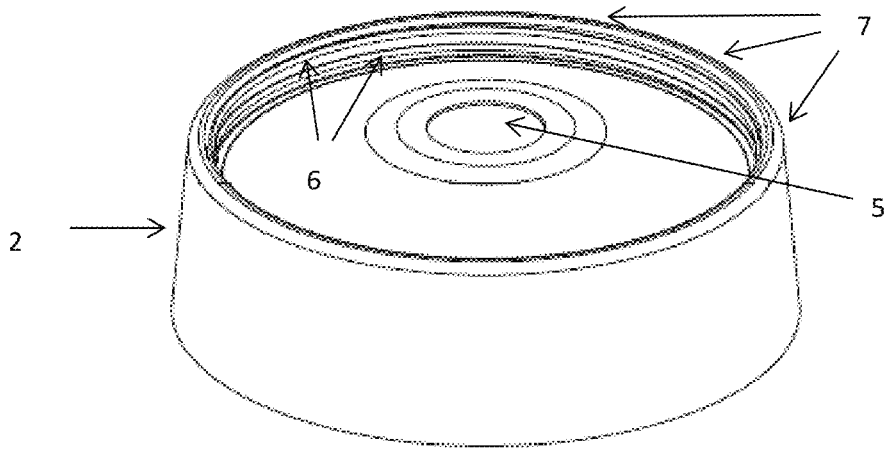
Figure 10:
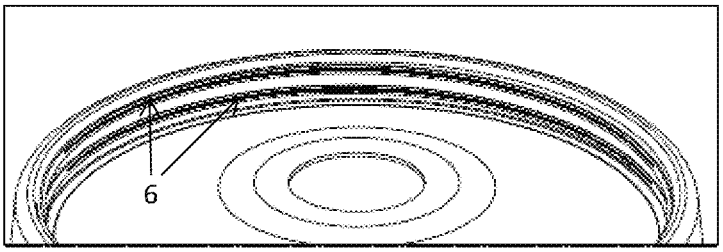
FIG. 10 shows an isometric detail view of the inner circular thread (6) of the circular thread base cover of the present invention.
Figure 11:
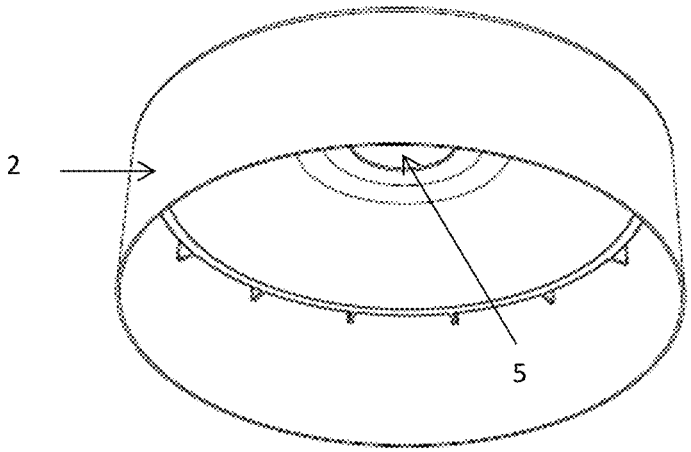
FIG. 11 shows a bottom isometric view of an exemplary circular thread base cover for a protective canister with light-distributing thread for protective exterior shade/luminaire of the present invention, in which (2) represents a circular thread base cover, and (5) represents a hole in the central part of the circular thread base cover.
Figure 12:
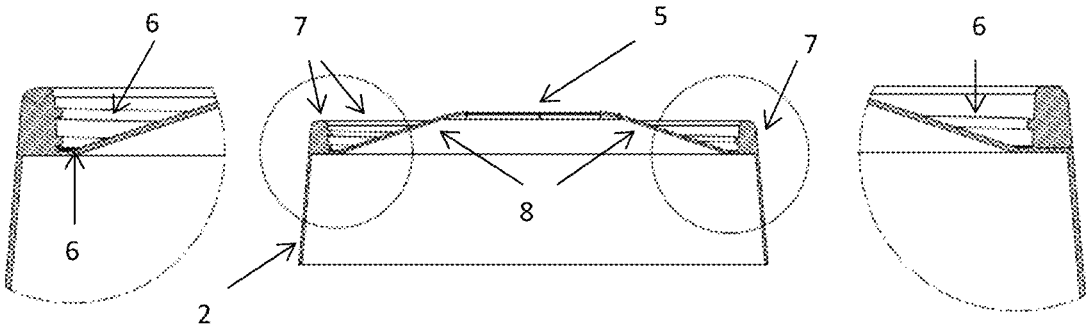

FIG. 12 shows a detail side cutaway view of an exemplary circular thread base cover for a protective canister with light-distributing thread for protective exterior shade/luminaire of the present invention, in which (2) represents a circular thread base cover, (5) represents a hole in the central part of the circular thread base cover, (6) represents an inner circular thread, (7) represents an upper circular wall, and (8) represents an angle of inclination in the central part from the hollow cylindrical body with hole of the circular thread base cover for easy fitting of a ceramic base/socket (not shown).

Figure 13:
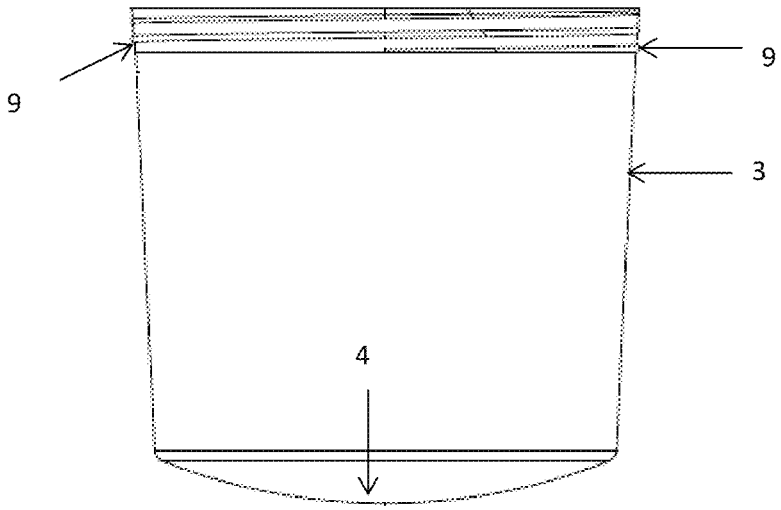

FIG. 13 shows a side view of an exemplary protective canister with light-distributing thread for protective exterior shade/luminaire of the present invention, in which (3) represents a protective canister with light-distributing thread to protect light bulbs, (4) represents a slight curvature that provides a better appearance and distributes the light emitted by the light bulbs, and (9) represents an outer circular thread to fit by twisting to an inner circular thread of a circular wall of the hollow cylindrical body of the cover (not shown) in a manner that installs and uninstalls easily, that ensures a secure assembly in a firm manner and that prevents theft of the light bulb and its parts.

Figure 14:
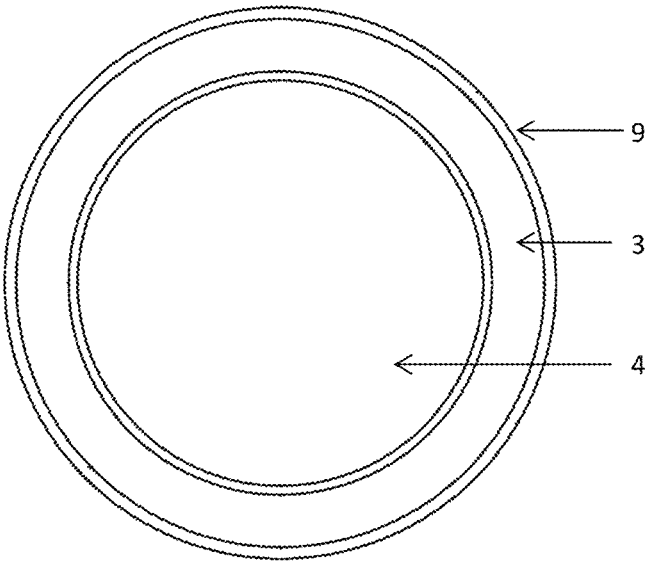

FIG. 14 shows a top view of an exemplary protective canister with light-distributing thread for protective exterior shade/luminaire of the present invention, in which (3) represents a protective canister with light-distributing thread to protect light bulbs, (4) represents a slight curvature that provides a better appearance and distributes the light emitted by the light bulbs, and (9) represents an outer circular thread to fit by twisting to an inner circular thread of a circular wall of the hollow cylindrical body of the cover (not shown) in a manner that installs and uninstalls easily.

Figure 15:
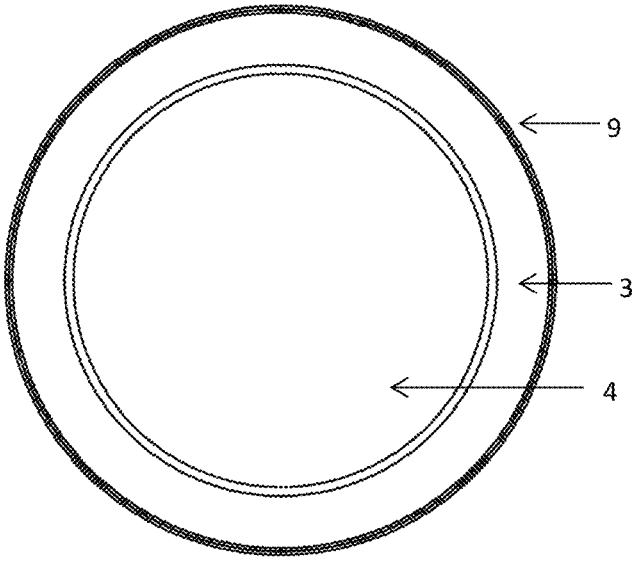

FIG. 15 shows a bottom view of an exemplary protective canister with light-distributing thread for protective exterior shade/luminaire of the present invention, in which (3) represents a protective canister with light-distributing thread to protect light bulbs, (4) represents a slight curvature that provides a better appearance and distributes the light emitted by the light bulbs, and (9) represents an outer circular thread to fit by twisting to an inner circular thread of a circular wall of the hollow cylindrical body of the cover (not shown) in a manner that installs and uninstalls easily.

Figure 16:
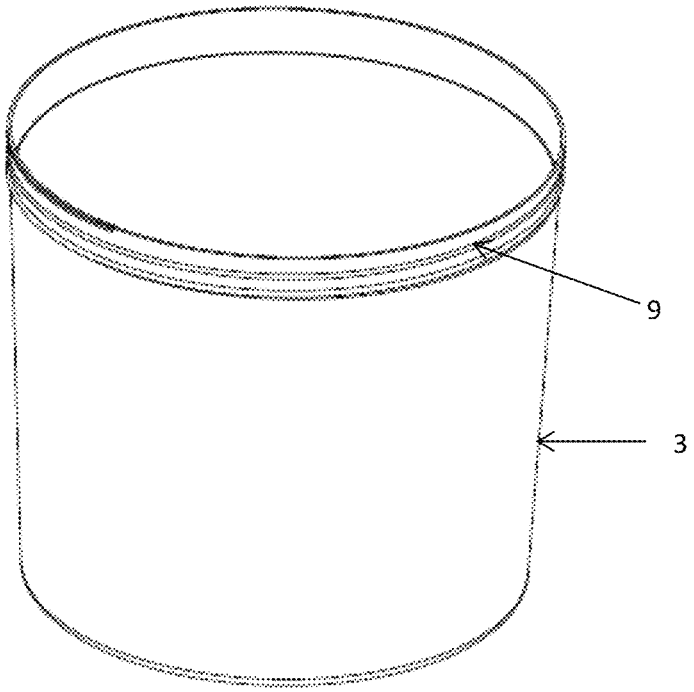

FIG. 16 shows a top isometric view of an exemplary protective canister with light-distributing thread for protective exterior shade/luminaire of the present invention, in which (3) represents a protective canister with light-distributing thread to protect light bulbs, and (9) represents an outer circular thread to fit by twisting to an inner circular thread of a circular wall of the hollow cylindrical body of the cover (not shown) in a manner that installs and uninstalls easily.

Figure 17:
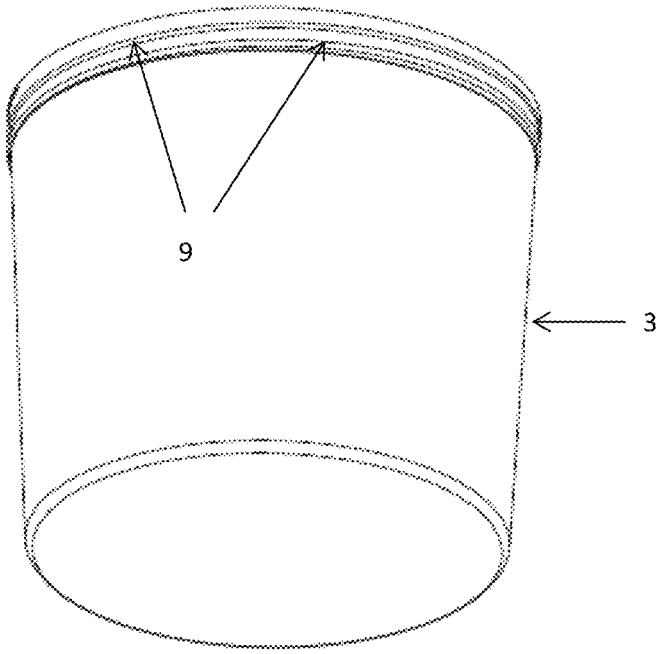

FIG. 17 shows a bottom isometric view of an exemplary protective canister with light-distributing thread for protective exterior shade/luminaire of the present invention, in which (3) represents a protective canister with light-distributing thread to protect light bulbs, and (9) represents an outer circular thread to fit by twisting to an inner circular thread of a circular wall of the hollow cylindrical body of the cover (not shown) in a manner that installs and uninstalls easily.

Figure 18:
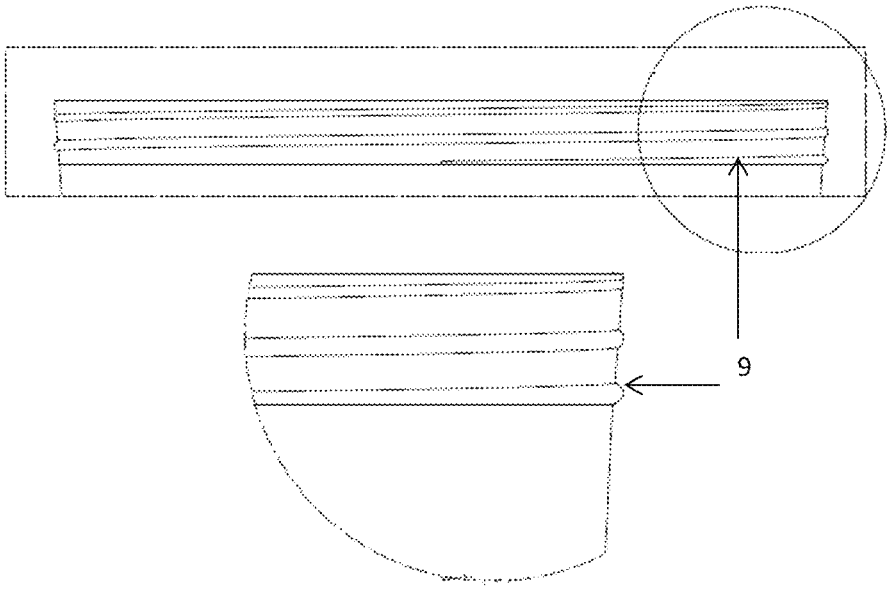

FIG. 18 shows a front view detailing an outer circular thread (9) of the protective canister with light-distributing thread for protective exterior shade/luminaire of the present invention.

Figure 19:
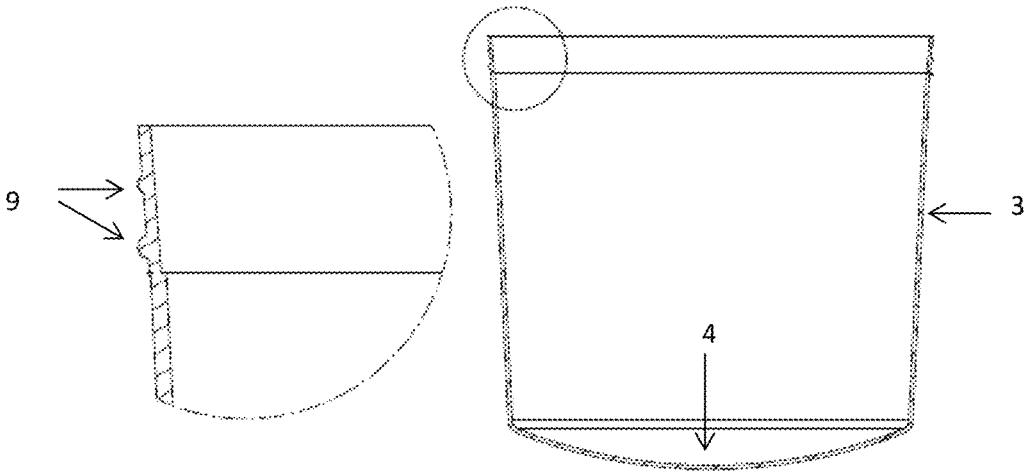

FIG. 19 shows a detail side cutaway view of an exemplary protective canister with light-distributing thread for protective exterior shade/luminaire of the present invention, in which (3) represents a protective canister with light-distributing thread to protect light bulbs, (4) represents a slight curvature that provides a better appearance and distributes the light emitted by the light bulbs, and (9) represents an outer circular thread to fit by twisting to an inner circular thread of a circular wall of the hollow cylindrical body of the cover (not shown) in a manner that installs and uninstalls easily.

Figure 20:
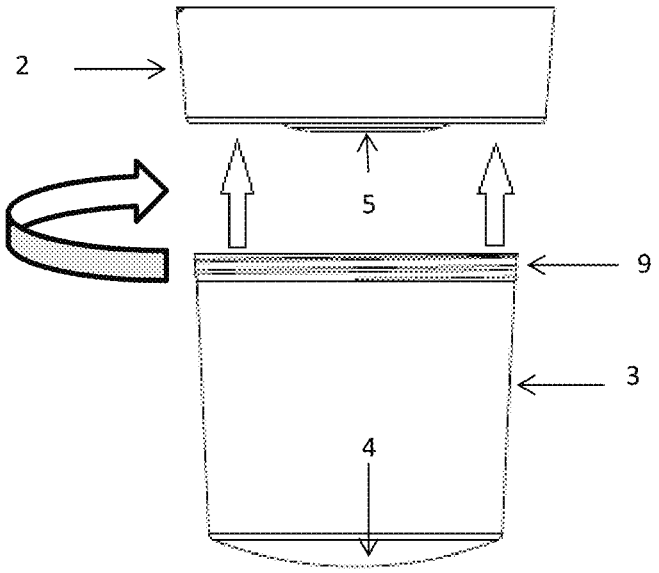

FIG. 20 shows a side cutaway view of a protective canister with light-distributing thread for protective exterior shade/luminaire of the present invention, in which (2) represents a circular thread base cover, (3) represents a protective canister with light-distributing thread to protect light bulbs, (4) represents a slight curvature, (5) represents a hole in the central part of the circular thread base cover, (9) represents an upper outer circular thread of protective canister with light-distributing thread, and arrows indicating the direction of assembly and rotation.

Figure 21:
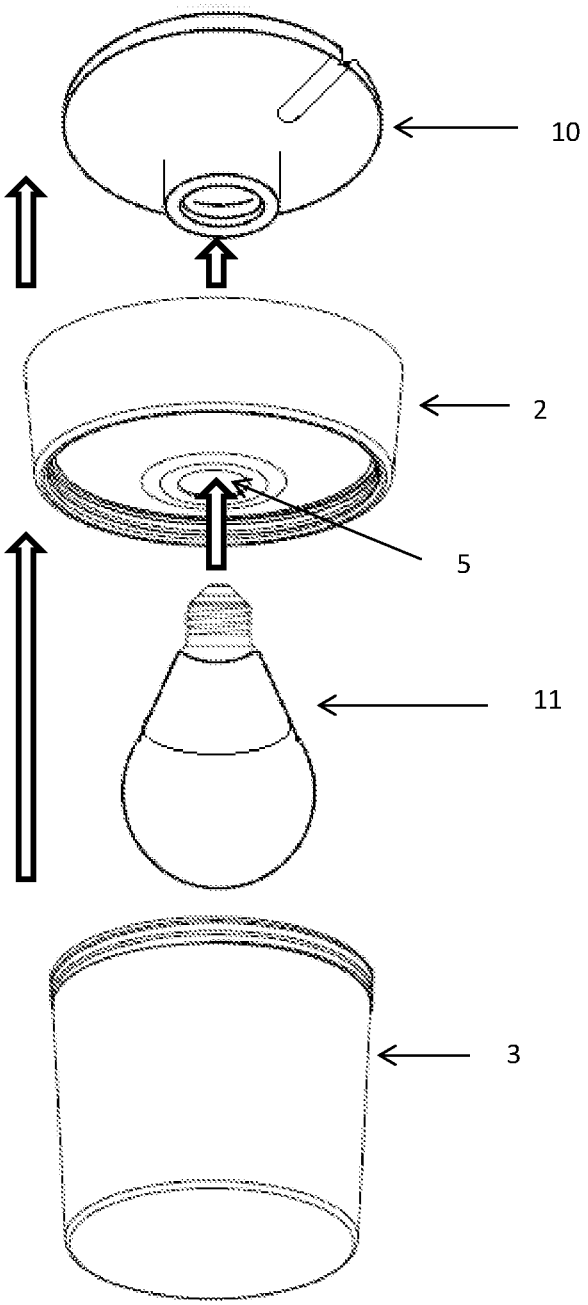

FIG. 21 shows an isometric side view of the assembly of an exemplary protective exterior shade/luminaire of the present invention, in which (10) represents a ceramic base/socket having a hole with a thread for threading a thread from a light bulb, (2) represents a circular thread base cover, (5) represents a hole in the central part of the circular thread base cover, (11) represents a light bulb of CLF savings (compact fluorescent lamp) with a thread for screwing in, and (3) represents a protective canister with light-distributing thread to protect light bulbs and arrows indicating the direction of assembly. In some embodiments the base cover (2) can be held in place in relationship to the ceramic base/socket (10) by the light bulb engaged therein. In such a case, the central hole (5) can have a diameter smaller than that of a portion of a light bulb to be engaged into the ceramic base. In another embodiment, the base cover (2) can be held in place in relationship (e.g. engaging or covering) the ceramic base/socket (10) by any other suitable mechanism, such as with clamps, screws, adhesives, clips, threads, etc. which can either removably or permanently affix the base cover (2) in relationship to the base/socket (10).

Figure 22:
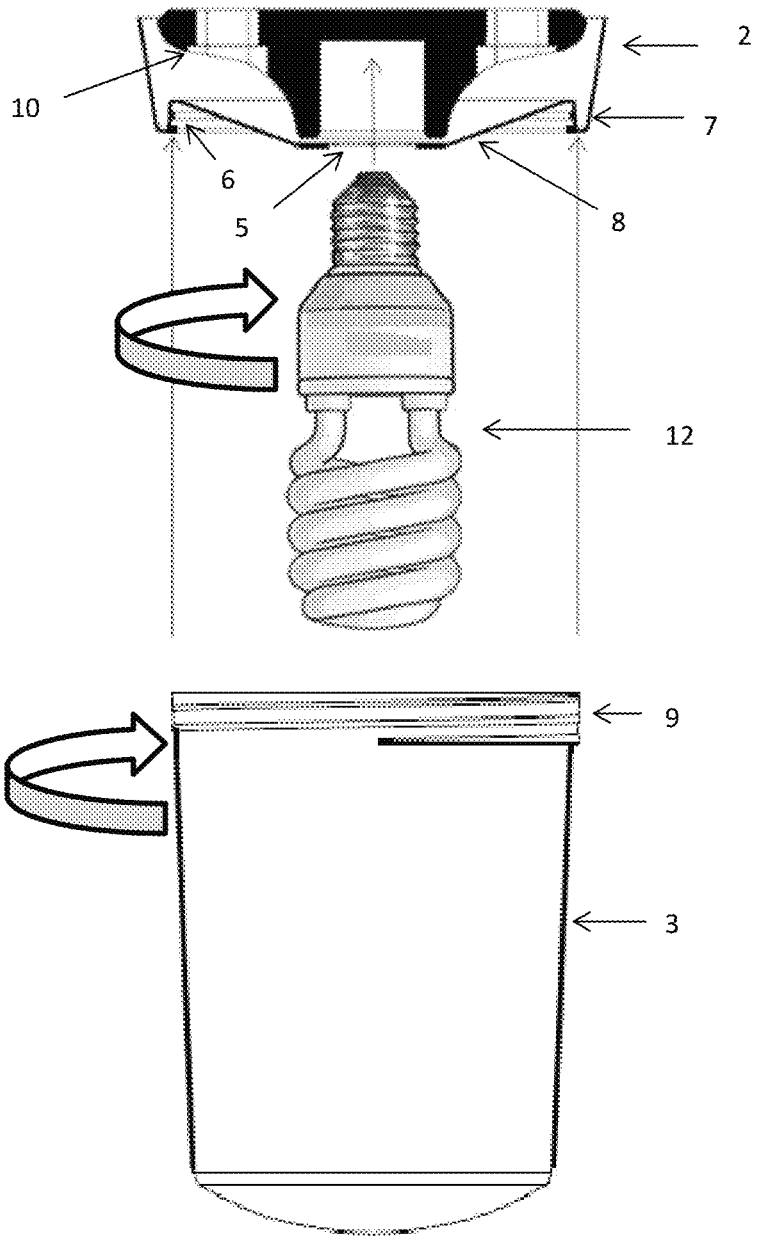

FIG. 22 shows a side section cut-away view of an exemplary protective exterior shade/luminaire of the present invention, in which (10) represents a ceramic base/socket having a hole with a thread for threading a thread from a light bulb, (2) represents a circular thread base cover, (5) represents a hole in the central part of the circular thread base cover, (12) represents a LED bulb type light bulb with a thread for screwing, (3) represents a protective canister with light-distributing thread to protect light bulbs, (7) represents an upper circular wall provided with an inner circular thread (6) to be threaded/unthreaded (tightened/untightened) by twisting to an upper outer circular thread (9) of a protective canister with light-distributing thread to protect light bulbs, (8) represents an angle of inclination in the central part of the hollow cylindrical body with hole of the circular thread base cover for easy fitting of a ceramic base/socket, and arrows indicating the direction of assembly and twisting.

Figure 23:
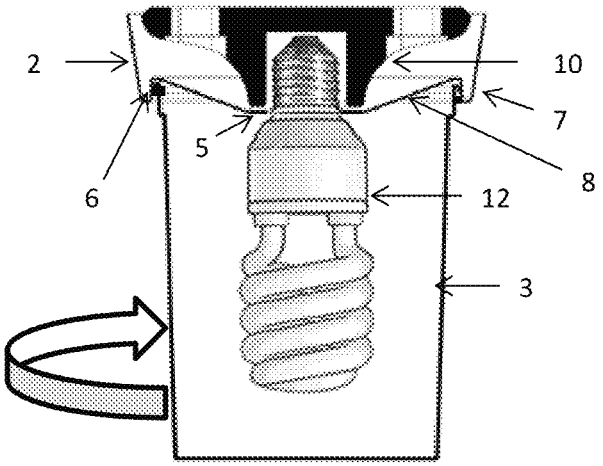

FIG. 23 shows a side sectional cutaway view of an assembled, threaded and fitted protective exterior shade/luminaire of an example of the present invention, in which (10) represents a ceramic base/socket having a hole with a thread for threading a thread from a light bulb, (2) represents a circular thread base cover, (5) represents a hole in the central part of the circular thread base cover, (12) represents a LED bulb type light bulb with a thread for screwing, (3) represents a protective canister with light-distributing thread to protect light bulbs, (7) represents an upper circular wall provided with an inner circular thread (6) to be threaded/unthreaded (tightened/untightened) by twisting to an upper outer circular thread of a protective canister with light-distributing thread to protect light bulbs, and (8) represents an angle of inclination in the central part of the hollow cylindrical body with hole of the circular thread base cover for easy fitting of a ceramic base/socket, and arrows indicating the direction of assembly and twisting.

The invention claimed is:

1. A protective exterior shade to protect a light & bulb installed in a ceramic socket comprising:

a circular base cover having a hollow cylindrical body, with a central part having a hole operable to pass a thread of a light bulb to a threaded hole of the ceramic socket, wherein the central part ofthe hollow cylindrical body has an angle ofinclination operable for fitting of a ceramic socket, wherein a lower part of the hollow cylindrical body has a peripheral circular wall provided with an inner circular thread operable to receive an upper outer circular thread of a light-distributing protective canister configured to protect the light bulb, wherein a diameter of the hollow cylindrical body is greater than a diameter of the ceramic socket, wherein a bottom of the hollow cylindrical body is positioned over the ceramic socket so that the hole of the hollow cylindrical body coincides with the threaded hole of the ceramic socket, so as to engage a thread of the light bulb into the threaded hole of the ceramic socket when assembled, wherein the circular base cover is coupled to the ceramic socket with an edge of the hole when the light bulb is assembled with the ceramic socket, and wherein a height of the hollow cylindrical body is equal to or less than a height of the ceramic socket such that it completely covers said ceramic socket; and wherein the light-distributing protective canister is operable to engage the circular base cover and protect the bulb engaged in the ceramic socket, said canister having a longitudinally elongated hollow semi-cylindrical body, a curvature at a bottom thereof, and an outer circular thread at the top portion thereof operable to engage the thread of the base cover.

2. The protective exterior shade according to claim 1, wherein the circular base cover, or the canister, or both comprise a rigid plastic, selected from polypropylene (PP) including a partially crystalline thermoplastic polymer, which is obtained from polymerization of propylene (or propene), high or low density polyethylene (PE), polyethylene terephthalate (PET), styrene-butadiene, acrylonitrile butadiene styrene polymer (ABS) in any color.

3. The protective exterior shade according to claim 1, wherein further the body that forms the $_i$ protective canister with light-distributing has a shape selected from the group consisting spherical, hemispherical, spiral, square, and diamond.

* * * * *